US007434374B2

(12) United States Patent
Romagnoli

(10) Patent No.: US 7,434,374 B2
(45) Date of Patent: Oct. 14, 2008

(54) METHOD AND LINE FOR THE HIGH-SPEED PACKAGING OF FILTER BAGS CONTAINING AN INFUSION PRODUCT

(75) Inventor: Andrea Romagnoli, San Lazzaro di Savena (IT)

(73) Assignee: Tecnomeccanica S.r.l., Villanova-Castenaso (IT)

( * ) Notice: Subject to any disclaimer, the term of this patent is extended or adjusted under 35 U.S.C. 154(b) by 5 days.

(21) Appl. No.: 11/704,480

(22) Filed: Feb. 9, 2007

(65) Prior Publication Data

US 2007/0186513 A1 Aug. 16, 2007

(30) Foreign Application Priority Data

Feb. 10, 2006 (IT) ..... BO2006A000094

(51) Int. Cl.
*B65B 57/02* (2006.01)
*B65B 9/06* (2006.01)
*B65B 51/16* (2006.01)

(52) U.S. Cl. ..... 53/449; 53/450; 53/479; 53/53; 53/55; 53/171; 53/550; 53/374.4

(58) Field of Classification Search ..... 53/450, 53/550, 449, 171, 174, 469, 479, 373.7, 374.3, 53/374.4, 376.2, 371.3, 371.4, 53, 55, 134.2, 53/475

See application file for complete search history.

(56) References Cited

U.S. PATENT DOCUMENTS 2,762,178 A * 9/1956 Campbell ..... 53/550
2,976,657 A * 3/1961 Cloud ..... 53/550
3,481,099 A * 12/1969 Clancy ..... 53/450
4,106,262 A * 8/1978 Aterianus ..... 53/450
4,183,964 A * 1/1980 Vinokur ..... 53/450
4,712,357 A * 12/1987 Crawford et al. ..... 53/450
5,347,791 A * 9/1994 Ginzl et al. ..... 53/450
6,332,305 B1 * 12/2001 Takahashi ..... 53/371.4
6,598,377 B2 * 7/2003 Takahashi ..... 53/550
6,837,024 B1 * 1/2005 Romagnoli ..... 53/170
6,948,292 B2 9/2005 Romagnoli
7,017,324 B2 * 3/2006 Battisti ..... 53/550
7,114,307 B2 * 10/2006 Tada et al. ..... 53/550
2003/0131565 A1 7/2003 Romagnoli (Continued)

FOREIGN PATENT DOCUMENTS

EP 1327589 A2 7/2003

(Continued)

*Primary Examiner*—Stephen F Gerrity
(74) *Attorney, Agent, or Firm*—Pearne & Gordon LLP

(57) ABSTRACT

A method and a line for the high-speed packaging of filter bags (1) containing an infusion product comprises at least three successive operating steps whereby: the filter bags (1) are wrapped in a continuous protective tubular envelope (2) by sealing a continuous V-shaped folded strip (3) along a longitudinal sealing line (5) and transversal sealing lines (6); the tubular envelope (2) is cut into lengths; and the filter bags (1), individually wrapped in respective envelopes (2), are placed in cartons. In the method and line (26) according to the invention, the transversal seal (6) is made in two successive steps as the continuous folded strip (3) moves through two separate consecutive sealing stations (7, 8), the first station (7) making a part of the transversal seal (6) and the second station (8) completing the same transversal seal (6).

25 Claims, 4 Drawing Sheets

U.S. PATENT DOCUMENTS

2004/0226263 A1* 11/2004 Romagnoli ..... 53/171

FOREIGN PATENT DOCUMENTS

IT BO2002A000480 7/2002
JP 06099952 A * 4/1994
JP 06179420 A * 6/1994
WO WO 92/15500 9/1992
WO WO 97/41032 11/1997

* cited by examiner

METHOD AND LINE FOR THE HIGH-SPEED PACKAGING OF FILTER BAGS CONTAINING AN INFUSION PRODUCT

BACKGROUND OF THE INVENTION

This invention relates to a method and line for the high-speed packaging of pre-formed filter bags containing metered quantities of an infusion product such as tea, chamomile or similar herbs.

Patent application BO 2002 A000480 in the name of the same Applicant as this invention discloses an automatic machine for making and packaging filter bags containing an infusion product. The production process implemented by the machine comprises the steps of: forming the filter bag and related accessories consisting of tag and connecting thread; filling the infusion product into the bag; forming the protective envelopes in which the filter bags are individually wrapped; and packaging the filter bags into cartons in predetermined quantities. The process is performed continuously, without intermittent motion, and at very high speeds.

The process may be broadly divided into two consecutive sub-processes: in the first sub-process, the filter bag is fully formed and filled with a metered charge of the infusion product; the second sub-process involves packaging the filter-bags by forming the envelopes in which they are individually wrapped and then placing the wrapped filter bags in cartons or boxes.

The two sub-processes are performed in two separate parts of the machine along two separate filter bag paths connected by an intermediate path, all these paths lying in a single plane which, for convenience, will be called the process plane of the filter bags and which is vertical and longitudinal relative to the machine.

More specifically, the filter bags, as they move along the first path in the process plane of the machine, lie in a horizontal position, that is to say, transversal to the process plane itself.

In the second path, on the other hand, the filter bags move along the process plane of the machine in a vertical position, that is to say, parallel to the process plane.

In the intermediate path between the first and the second path, the filter bags are made to rotate by a turning unit one by one from the original position, transversal to the process plane, to the final position, parallel to the process plane.

The turning unit basically consists of two gripper wheels revolving about axes at right angles to the process plane and substantially tangent to each other. The first wheel is interfaced with the first path where the filter bags are advanced in a position transversal to the process plane. The second wheel, on the other hand, is interfaced with the second path where the filter bags are advanced in a position parallel to the process plane.

The two wheels of the turning unit counter-rotate at equal peripheral speeds.

The bags, picked up by the grippers of the first wheel, thus describe a circular arc as one with the first wheel and then, after reaching the area of tangency between the two wheels, are transferred one by one to the grippers of the second wheel which in turn transports them along another circular arc, with opposite concavity to that of the first arc, and which releases them one by one in the V-shaped fold of a strip of heat-sealable envelope material advancing along the second path of the filter bags which, as stated above, relates to the second sub-process.

The second sub-process basically comprises three steps, namely, sealing, cutting and cartoning. Sealing is performed both longitudinally and transversally to the strip of envelope material.

The longitudinal seal is performed continuously and involves joining the free longitudinal edges of the V-shaped folded strip, to form a sort of closed, flattened tube containing the filter bags at regular intervals from each other.

Transversal sealing, on the other hand, is performed intermittently and involves creating from the tube of heat-sealable paper a continuous series of separate compartments, each containing a single filter bag.

In the next step, the flattened tube is cut into separate lengths, each corresponding to a single filter bag.

The lengths of cut tube, constituting individually wrapped filter bags, are then fed to a cartoning unit which: checks them, counts them and places them in cartons.

A machine made in this way offers several important advantages, including that of working along the process plane of the machine with a continuous product flow and at a high production speed.

Machines of this kind have also proved capable of making the filter bags at speeds considerably higher than those of prior machines.

At present however, this potential cannot be utilized to the full because the packaging line is unable to operate at speeds as high as those of the forming line which makes the filter bags.

In fact, the timing of the sealing operations—especially the transversal seals—on the flattened tube from which the envelopes are made, poses a critical limit on current packaging lines.

The transversal seals require a minimum length of time which cannot be reduced below a certain threshold, dependent on the time required for the glue of the envelope material to soften and then re-solidify.

Another critical aspect preventing the packaging line from operating at the same high speeds as the forming line is the fact that the speed at which the strip of envelope material can be advanced is considerably lower (in the order of 30%) than the rotation speed of the turning unit.

Thus, each filter bag, after being released into the V-shaped folded strip of envelope material must be slowed positively and precisely. An expert in the trade will easily understand that further increasing the forming speed would require a highly complex mechanisms making it extremely problematic to slow the filter bag down with a degree of precision sufficient to correctly coordinate the exact point in time at which the filter bag is released at exactly the right point on the moving strip of envelope material.

Yet another critical aspect preventing the packaging line from operating at higher speeds to match those of the forming line is the fact that the higher the speed of the turning unit the higher the centrifugal forces in the curved paths of the filter bags, causing the infusion product in each filter bag to accumulate mainly on the bottom of the filter bag. That means the infusion product is not evenly spread inside the filter bags, causing bulges that make the filter bags too wide to fit properly inside the cartons in the required numbers, differing according to carton size, and thus creating packaging problems.

SUMMARY OF THE INVENTION

This invention therefore has for an aim to overcome the above mentioned drawbacks in order to allow automatic forming machines for making filter bags containing metered quantities of infusion product to operate, without limitations, at their highest speeds.

In accordance with the invention, this aim is achieved by a method for the high-speed packaging of pre-formed filter bags containing metered quantities of an infusion product, said method being implemented by a packaging line, also forming the subject-matter of this invention, designed to equip an automatic machine for forming the filter bags fed to the packaging line.

The technical characteristics of the invention according to the aforementioned aim may be easily inferred from the contents of the appended claims.

BRIEF DESCRIPTION OF THE DRAWINGS

The advantageous aspects of the invention are more apparent from the detailed description which follows, with reference to the accompanying drawings which illustrate preferred embodiments of the invention provided merely by way of example without restricting the scope of the inventive concept, and in which.

DESCRIPTION OF THE PREFERRED EMBODIMENTS

Figure 1:
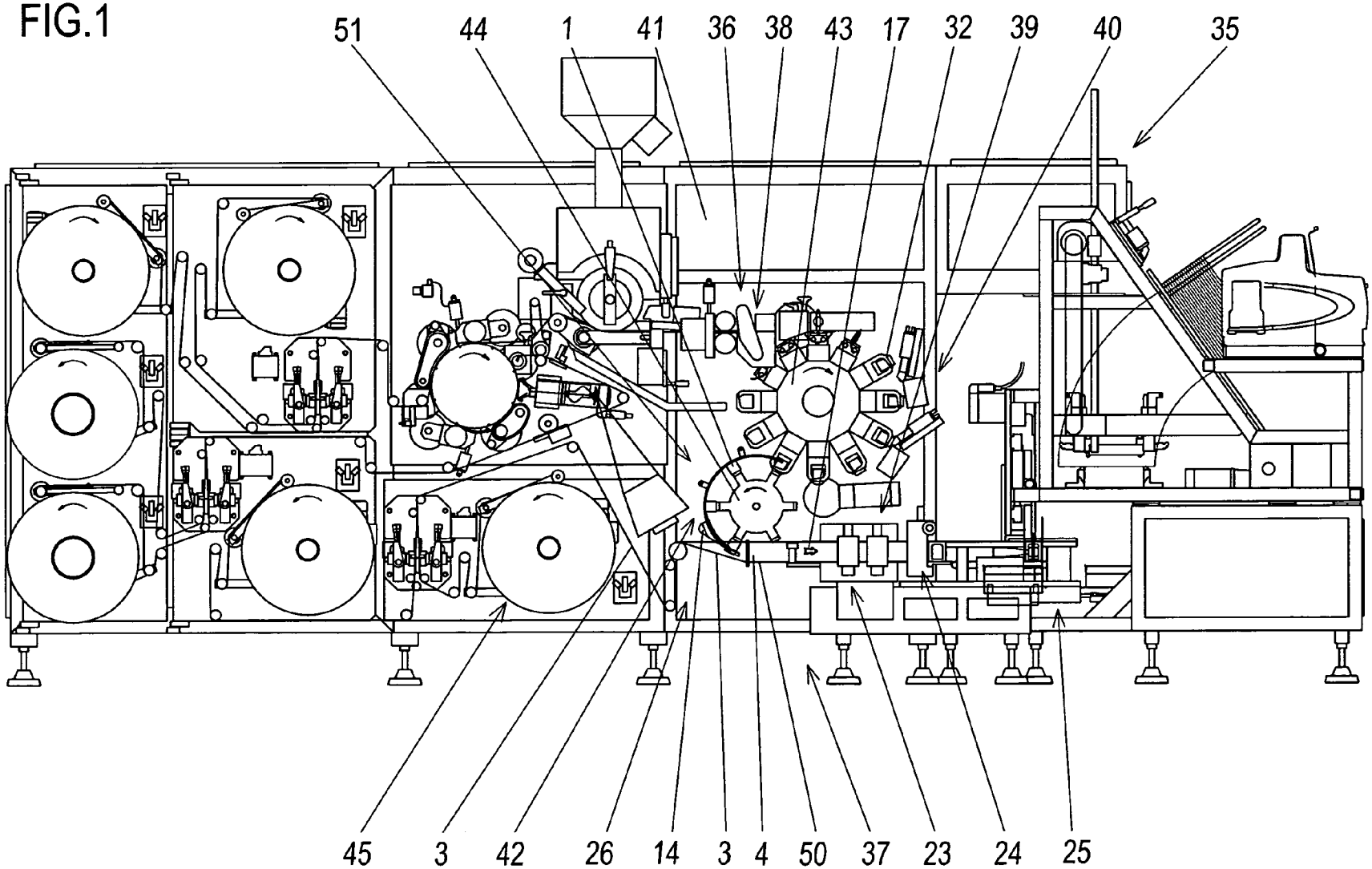
FIG. 1 is an elevation view of an automatic machine equipped with a packaging line according to the invention.

FIG. 1 illustrates in its entirety an automatic machine 35 for making and packaging a filter bag 1 containing a metered quantity of infusion product such as tea, chamomile and similar herbs.

Figure 4:
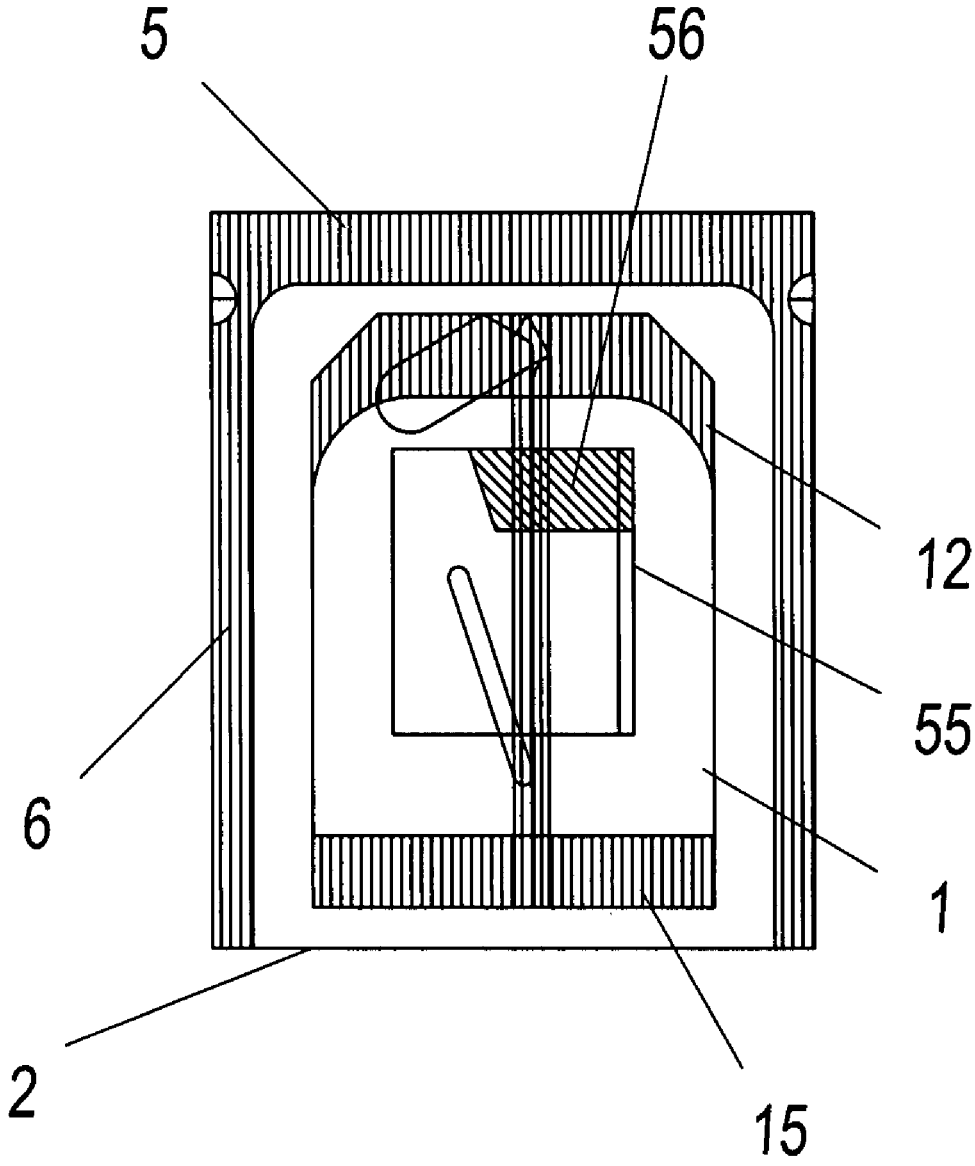
FIG. 4 is an assembly view of a wrapped filter bag made by the machine illustrated in the drawings listed above.

An example of the filter bag 1, which is per se of well known type, is shown in FIG. 4. As shown in this drawing, the filter bag 1, containing a metered quantity of an infusion product, has a head 12, a bottom portion 15, a pickup tag 55 and a connecting thread 56. The filter bag 1 is individually wrapped in a protective envelope 2.

The machine 35 of FIG. 1 implements a production process which is per se well known to experts in the trade and which is described in detail in document BO2002A000480, in the name of the same Applicant as this invention. The process can be may be broadly divided into two consecutive sub-processes: in the first sub-process, the filter bags 1 are fully formed and each is filled with a metered charge of the infusion product; the second sub-process, on the other hand, involves the actual packaging of the filter-bags 1 by forming the envelopes 2 and then placing the filter bags 1, each wrapped in an envelope 2, in cartons.

The two sub-processes are performed in two different parts of the machine 35 of FIG. 1, denoted in their entirety by the numerals 36 and 37, extending along two separate filter bag 1 paths 38 and 39 connected to each other by an intermediate path 40; the paths 38, 39 and 40 all lying in a single plane 41 that is vertical and longitudinal relative to the machine 35.

More specifically, the filter bags 1, as they move along the first path 38 in the process plane 41 of the machine 35, lie in a horizontal position transversal to the process plane 41 itself.

In the second path 39, on the other hand, the filter bags 1 move along the process plane 41 of the machine 35 in a vertical position parallel to the process plane 41.

In the intermediate path 40 between the first path 38 and the second path 39, the filter bags 1 are gradually made to rotate one by one from the original position to the final position, parallel to the process plane 41; this rotational motion being imparted to the filter bags 1 by a turning unit 42 essentially comprising two wheels 43 and 44 which mount grippers 32 and 31 projecting radially from the edge of each wheel into the surrounding space.

The wheels 43 and 44 are substantially tangent to each other and revolve about axes at right angles to the process plane 41. The first wheel 43 is operatively interfaced with the first path 38 from which it receives the filter bags 1 advancing in a position transversal to the process plane 41. The second wheel 44, on the other hand, is interfaced with the second path 39 to which it transfers the filter bags 1 advancing in a position parallel to the process plane 41.

The two wheels 43 and 44 of the turning unit 42 counter-rotate at equal peripheral speeds.

The filter bags 1, held by the grippers 32 of the first wheel 43, thus describe a circular arc (clockwise in FIG. 1) as one with the first wheel 43, and then, after reaching the area of tangency between the two wheels 43 and 44, are transferred one by one to the grippers 31 of the second wheel 44 which in turn transports them along another circular arc (in counter-clockwise direction) and releases them one by one to feed an underlying packaging line 26 along which the filter bags 1 describe the second and final path 39 defined above.

The packaging line 26—which forms the specific subject-matter of this invention—is adapted to run at speeds matching the speeds of the filter bags 1, which may be extremely high.

The line 26 essentially comprises three working sections 23, 24 and 25 located one after the other along the second path 39 of the filter bags 1. Upstream of the first working section 23 of the line 26 there is an unwinding unit 45 that subtends between it and the first working section 23 a continuous strip 3 of heat-sealable material for envelopes 2. More specifically, the strip 3 is advanced in a straight line, in the direction of feed indicated by the arrow 17, between the unit 45 and the sections 23 and 24 of the line 26.

The strip 3 advances in the folded state. Thus, as clearly shown in FIG. 3, the strip 3 is folded onto itself to form two wings 4 that converge towards a longitudinal fold line 50 (FIG. 1) running along the middle of the strip 3, delimiting a V-shaped fold, open at the top.

At an initial section 51 of the line 26, the outermost part of the second gripper wheel 44 of the turning unit 42 is interposed and rotates between the wings 4 in such a way as to feed the packaging line 26 by allowing the grippers 31 to release the filter bags 1 so that they are transferred one by one to the area between the wings 4 of the strip 3.

At the initial section 51, the line 29 comprises means 13 and 14 for keeping the filter bags 1 firmly in a flat state while they are being fed in this way.

Figure 2:
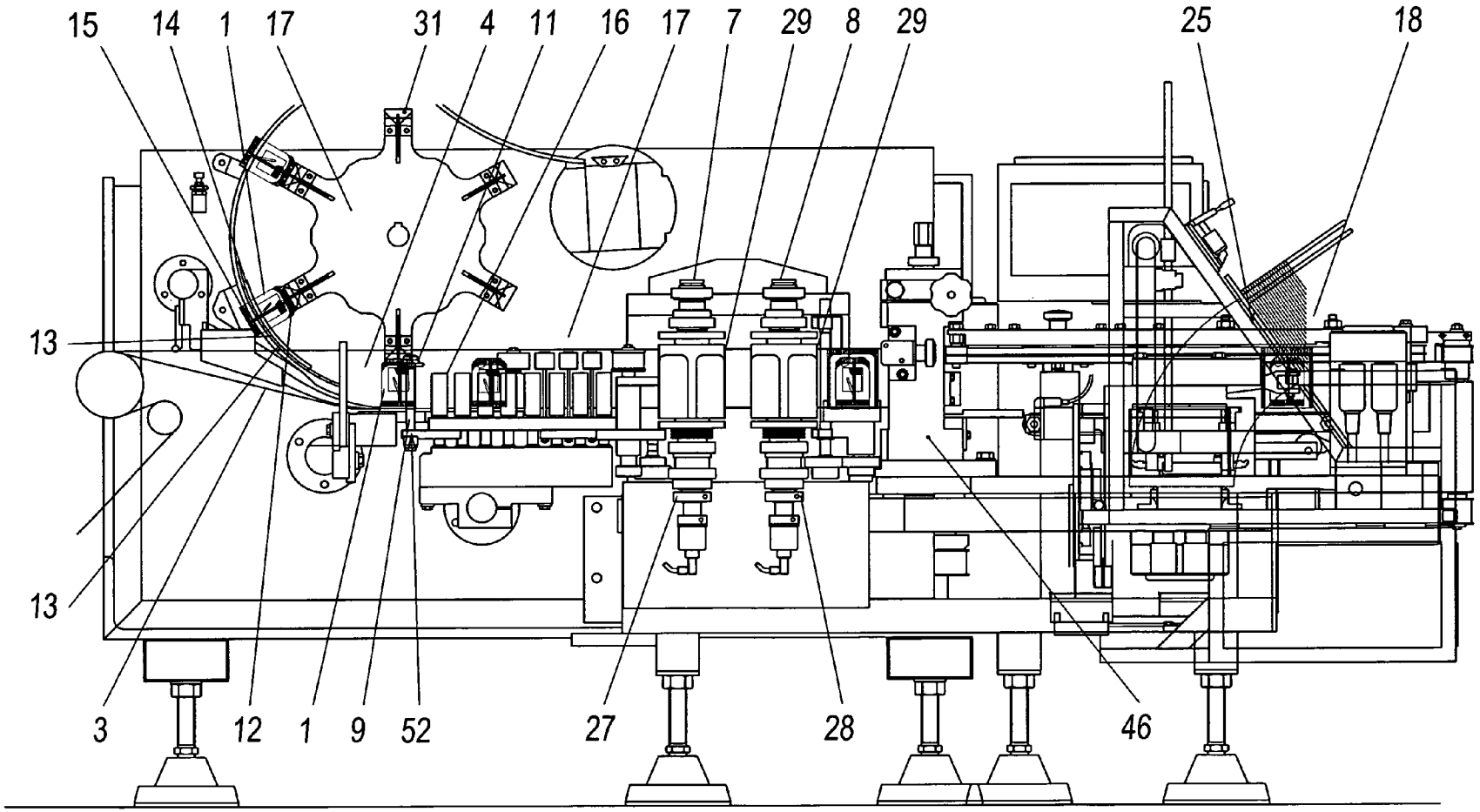
FIG. 2 is an elevation view of a part of the machine of FIG. 1 and shows a packaging line integrated in the machine.

That is because, as clearly shown in FIG. 2, the second gripper 31 mounting wheel 44 of the turning unit 42 holds each filter bag 1 by its head 12 only. Therefore, to ensure that the entire filter bag 1 remains firmly in the same plane as the head 12, the line 29 comprises two parallel shoulders 14 having the shape of a circular arc, which guide the bottom portion 15 of each filter bag 1 between them as the filter bags 1 move past.

The shoulders 14 have a series of fine nozzles 13, located opposite each other, which blow air under pressure against the filter bag 1 as it passes between the shoulders 14 themselves in such a way as to keep it firmly in the same plane as its head 12. It should be noticed that the pneumatic action applied by the nozzles 13 helps prevent the bulging effect on the filter bag 1 caused by the accumulation of all the infusion product on the bottom of the filter bag 1 due to the centrifugal force the filter bags 1 are subjected to as they are transported by the second wheel 44 of the turning unit 42.

The peripheral speed of the second gripper wheel 44 of the turning unit 42, which, as stated, feeds the line 26, is much higher than the speed at which the strip 3 is advanced. Therefore, to ensure that the filter bags 1 released by the grippers 31 without stopping are precisely coordinated with the strip 3 and slow down to exactly the same lower speed as the latter, the line 26 comprises slowing means 9, 11 and 52 designed to reduce the speed of the filter bags 1 stopping them with respect to the strip 3 above the latter at a precisely predetermined and repeatable position.

These filter bag 1 slowing means essentially comprise a pair of bilateral spring pins 9 transversal to the wings 4 of the folded V-shaped strip 3, oppose each other in a direction transversal to the wings 4 and have, interposed between them, the continuous strip 3 of material from which the envelopes 2 are made.

More specifically, as shown in FIG. 2, each spring pin 9 includes a fixed cylindrical supporting body 52 and has at one end a respective free turning disc-shaped member 11 projecting in offset fashion. The disc-shaped members 11 are pressed against each other by the spring action of the pin 9, thus holding between them the strip 3 of material from which the envelopes 2 are made. This action effectively slows down the filter bag 1 once it has been released between the wings 4 of the strip 3 and also allows the filter bag 1 and the strip 3 of heat-sealable material to be held properly together as they advance as one.

Downstream of the slowing means 9, 11 and 52, the line 29 comprises squeezing means 16 designed to redistribute the infusion product inside the filter bag 1, moving at least a part of it away from the bottom portion 15 of the filter bag 1. The purpose of this is to distribute the infusion product more uniformly thereby reducing the thickness of the filter bag 1 at the points where the latter tends to bulge.

More specifically, the squeezing means comprise a plurality of roller pairs 16 positioned one after the other along the line 26 on each side of the strip 3 of material from which the envelopes 2 are made. The spacing between the rollers 16 of each pair—which have a rigid structure—gradually decreases from one pair of rollers 16 to the next in the feed direction 17 of the strip 3 of material from which the envelopes 2 are made. This gradually decreasing spacing causes the filter bags 1 to move through a gap that becomes narrower and narrower, thus gradually decreasing the thickness of the filter bags 1.

The first working section 23 of the line 26 is located downstream of the squeezing means 16 and is designed, in particular, to form the protective envelopes 2 by making a longitudinal seal 5 and a series of transversal seals 6 on the continuous strip 3 of envelope 2 material. The longitudinal seal 5 is continuous and forms the strip 3 into a flattened tube containing the filter bags 1. The transversal seals 6 are made at regular intervals corresponding to the spacing of the filter bags 1 positioned inside the flattened tube formed by the longitudinal seal 5. The transversal seals 6 are designed to create a series of closed compartments, each containing a single filter bag 1, inside the flattened tube.

More specifically, the first section 23 includes two sealing stations 7 and 8 equipped with two separate and successive sealing units 27 and 28. The sealing units 27 and 28, besides making the longitudinal seal 5, are designed to make each transversal seal 6 on the continuous strip 3 in two consecutive steps, the first unit 27 making the first part of the seal and the second unit 28 completing it. Thus, strip 3 feed is no longer dependent on the time required to soften and re-solidify the glue which, especially in the case of the transversal seals 6, is a critical factor affecting the feed speed of the strip 3. This has the advantage of allowing the strip 3 of envelope 2 material to be fed at an average speed that is twice the speed at which it would have to be fed if the transversal seal were made by a single sealing unit.

Figure 3:
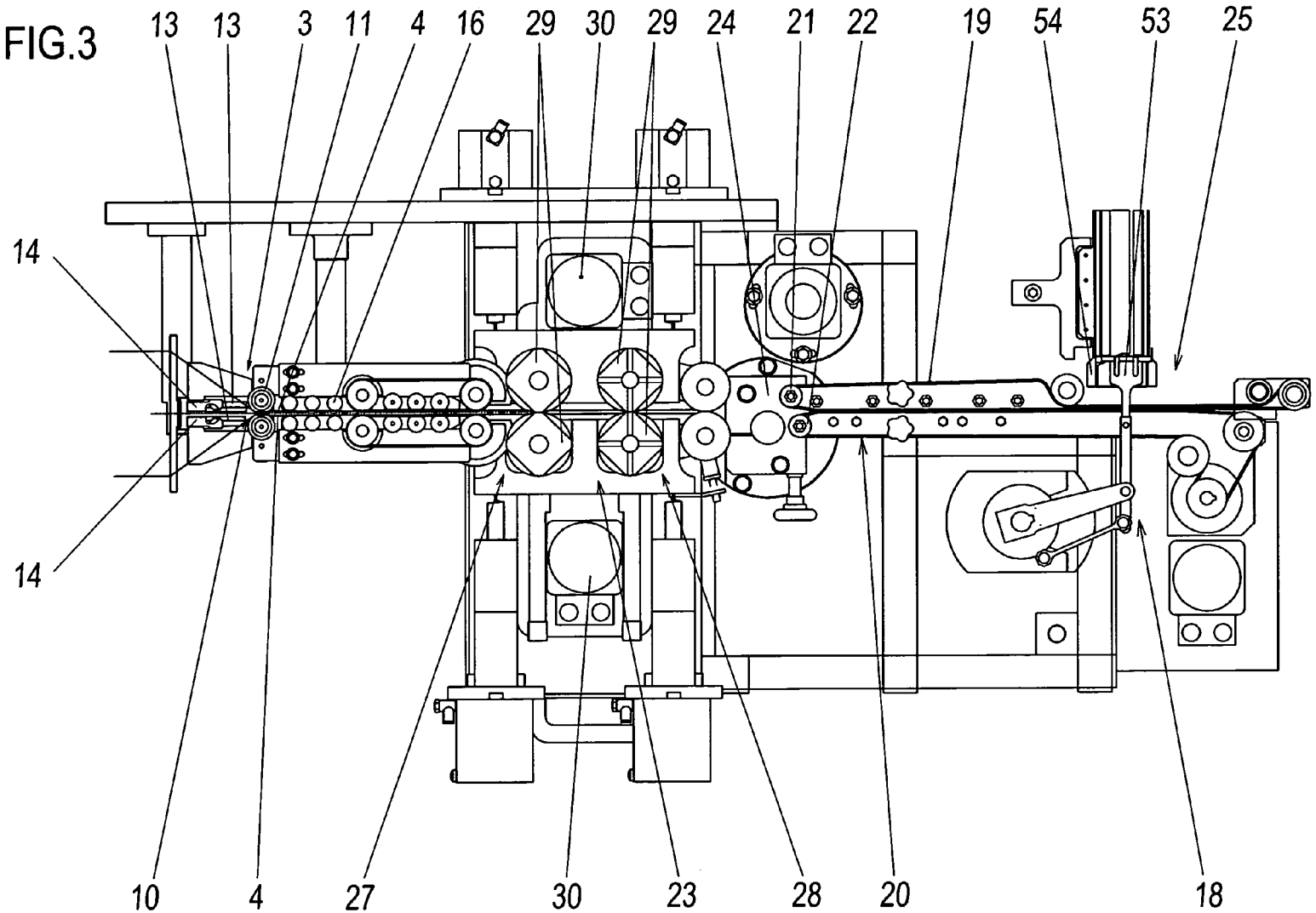
FIG. 3 shows the packaging line of FIG. 2 in a plan view from above.

As shown in particular to FIG. 3, each sealing unit 27 and 28 comprises a pair of sealing rollers 29 that rotate about an axis of symmetry and are positioned on each side of, and transversely to, the strip 3, while pressing against each other. Further, each sealing unit 27 and 28 is equipped with an independent drive motor 30. Usually, the motors 30 are driven in parallel. However, their independent drive systems allow full and accurate control of each of the two sealing units 27 and 28, independent of the other, when required.

Immediately downstream of the first working section 23 and, more specifically, at the second sealing unit 28, the feed line 26 comprises the second working section 24 which is designed to cut the previously fully sealed, flattened tube into predetermined lengths.

The section 24 comprises one or more blades 46 for cutting the flattened tube into lengths at the transversal seals 6 and feeding the lengths thus separated individually at high speed along the path 39 of the line 26.

Downstream of the second section 24, the line 26 comprises synchronizing means 19 and 20 for coordinating the tube lengths—that is to say, the filter bags 1 individually wrapped in respective envelopes 2—and synchronizing their speed with cartoning means 18 forming part of a third working section 25 located further along the packaging line 26 in the feed direction 17 of the continuous strip 3 of envelope 2 material.

More specifically, these speed synchronizing means comprise two continuous conveyor belts 19 and 20 having conveyor sections 21 and 22 placed face to face and in contact with each other. The filter bags 1 interposed between the conveyor sections 21 and 22 are advanced along the line 26 at variable speed, that is to say, accelerating or decelerating according to their instantaneous speed relative to the instantaneous position of the cartoning means 18 so as to coordinate the feed flow to the cartoning means 18 when the filter bags 1 come within their range.

The cartoning means 18 are made to a conventional design, including a mobile paddle 53 and a fixed buffer 54 for stacking and counting the filter bags 1. The paddle 53 and the stacking buffer 54 are positioned in line with each other on each side of the path 39 of the filter bags 1 and transversally to the path 39.

More specifically, the paddle 53 is reciprocatingly driven in a direction transversal to the path 39 of the filter bags 1 in such a way as to rhythmically cross the path, intercept the filter bags 1 moving along it at that moment and push them into the stacking and counting buffer 54.

The packaging line 26 also comprises means for inspecting each filter bag 1 and which, if the latter conforms with specifications, output a signal enabling the cartoning means 18 to carton the passing filter bag 1 or, if it does not conform with specifications, inhibit cartoning so that the filter bag 1 is allowed to move past the cartoning means 18 towards a reject container further downstream without being pushed by the paddle 53 into the buffer 54 from which it would subsequently be transferred into a carton.

It should be stressed that this mode of inspecting the quality of the filter bags 1 makes the production rate of the machine 35, or of the packaging line 26, totally independent of the number of products rejected.

The invention described has evident industrial applications and may be modified and adapted in several ways without thereby departing from the scope of the inventive concept. Moreover, all the details of the invention may be substituted by technically equivalent elements.

What is claimed is:

1. A method for the high-speed packaging of pre-formed filter bags (1) containing metered quantities of an infusion product, comprising at least three steps, in the first of which the filter bags (1) are wrapped in a protective tubular envelope (2) formed by a longitudinal seal (5) and a transversal seal (6) making a flattened tube from a continuous strip (3) of envelope (2) material folded into a V shape with wings (4) between which the filter bags (1) are suitably placed at regular intervals from each other; in the second step, the tube being cut into predetermined lengths, each containing one filter bag (1) wrapped in an envelope (2); and in the third step the filter bags (1), wrapped in the envelopes (2), being placed in cartons; wherein the transversal seal (6) is made in two successive steps as the continuous folded strip (3) moves through two separate consecutive sealing stations (7, 8), the first station (7) making a part of the transversal seal (6) and the second station (8) completing the rest of the same transversal seal (6); the step of making the seals (5; 6) being preceded by a feeding step in which the filter bags (1) are released between the wings (4) of the continuous strip (3), said feeding step being implemented by releasing the filter bags (1) in a direction substantially tangential to the strip (3) and at a speed higher than the speed at which the strip (3) advances; said feeding step being performed while holding the filter bag (1) by a respective head (12) and keeping the filter bag (1) in a flat condition firmly in the same plane as the head (12) by jets of air under pressure blown onto the filter bag by nozzles (13) mounted on two parallel shoulders (14) between which at least the bottom portion (15) of the filter bag (1) passes.

2. The method according to claim 1, wherein the feeding step comprises a step of slowing down the filter bags (1) so that, at a predetermined position, the speed of the filter bags (1) is synchronized with that of the continuous target strip (3) of material.

3. The method according to claim 2, wherein the step of slowing down the filter bags (1) is performed by at least one pair of bilateral spring pins (9) transversal to the wings (4) of the folded V-shaped strip (3), designed to oppose each other in a direction transversal to the strip (3) and having, interposed between them, said continuous strip (3) of material from which the envelopes (2) are made.

4. The method according to claim 3, wherein the slowing down step is performed at least by locally narrowing the end edges (10) of the folded wings (4) of the continuous strip (3) of material from which the envelopes (2) are made.

5. The method according to claim 4, wherein the local narrowing is accomplished by contact between two disc-shaped members (11) mounted tangent to each other on one end of each of the spring pins (9), with the continuous strip (3) of material from which the envelopes (2) are made passing between them.

6. The method according to claim 1, comprising a step of gradually squeezing the filter bags (1) in order to redistribute the infusion product inside each filter bag (1), moving at least a part of the infusion product away from the bottom portion (15) of the filter bag (1).

7. The method according to claim 6, wherein the squeezing step is performed by a plurality of roller pairs (16) positioned one after the other, the rollers (16) of each pair being mounted on each side of the strip (3) of material from which the envelopes (2) are made; the spacing between the rollers (16) of each pair gradually decreasing from one pair of rollers (16) to the next in the feed direction (17) of the strip (3) of material from which the envelopes (2) are made.

8. The method according to claim 7, wherein the rollers (16) have a rigid structure.

9. The method according to claim 6, wherein the squeezing step precedes a step of heat sealing the continuous strip (3) of material from which the envelopes (2) are made.

10. The method according to claim 1, comprising, prior to the step of cartoning the filter bags (1), a step of synchronizing the feed speed of the filter bags (1) with cartoning means (18), said synchronizing step being designed to maintain a continuous flow of filter bags (1) fed to the cartoning means (18).

11. The method according to claim 10, wherein the step of synchronizing the speed is performed by two continuous conveyor belts (19, 20) having conveyor sections (21, 22) placed face to face and in contact with each other, the filter bags (1) passing between the conveyor sections (21, 22) being accelerated or decelerated according to their instantaneous speed and relative to the instantaneous position of the cartoning means (18) located further on in the feed direction (17) of the strip (3) of material from which the envelopes (2) are made.

12. The method according to claim 11, wherein the cartoning step follows a step of inspecting each filter bag (1), during which, if the filter bag conforms with specifications, an output signal is generated to enable the cartoning means (18) to carton the passing filter bag (1) or, if the filter bag does not conform with specifications, to inhibit cartoning so that the filter bag (1) is allowed to move past the cartoning means (18) towards a reject container further downstream.

13. The method according to claim 1, wherein the shoulders (14) have the shape of a circular arc.

14. A line for the high-speed packaging of pre-formed filter bags (1) containing metered quantities of an infusion product, comprising at least three consecutive working sections (23, 24, 25), in the first of which (23) the filter bags (1) are wrapped in a protective tubular envelope (2) formed by a longitudinal seal (5) and a transversal seal (6) making a flattened tube from a continuous strip (3) of envelope (2) material folded into a V shape with wings (4) between which the filter bags (1) are suitably placed at regular intervals from each other; in the second working section (24), the flattened tube being cut into predetermined lengths; and in the third working section (25) the filter bags (1), wrapped in the envelopes (2), being placed in cartons; wherein the first section (23) of the line (26) includes two separate and successive sealing units (27, 28) designed to make each transversal seal (6) on the continuous strip (3) in two consecutive steps, the first unit (27) making the first part of the seal and the second unit (28) completing the seal; and wherein the line further comprises means (13, 14) for keeping the filter bag (1) in a flat condition while the filter bag (1) is being fed above the continuous strip (3) of material from which the envelopes (2) are made, said means (14) being designed to keep the filter bag (1) firmly in the same plane as a head (12) which is in turn held by grippers (31) on a wheel (32) that operates in conjunction with the strip (3); said means (13. 14) for keep the filter bag (1) in a flat condition comprising two parallel shoulders (14), between which at least the bottom portion (15) of the filter bag (1) passes, and which comprise nozzles (13) that blow jets of air under pressure on the filter bag (1).

15. The line according to claim 14, wherein each sealer unit (27, 28) in the first working section (23) comprises a pair of sealing rollers (29) positioned on each side of and transversely to the strip (3) and pressing against each other.

16. The line according to claim 15, wherein each sealer unit (27, 28) in the first working section (23) is driven by an independent motor (30).

17. The line according to claim 16, wherein the drive motors (30) of the sealing units (27, 28) of the first working section (23) are driven in parallel with each other.

18. The line according to claim 15, comprising slowing means (9; 11, 52) designed to reduce the speed of the filter bags (1) fed above the strip (3) until they reach a predetermined position where they are synchronized with the speed of the continuous strip (3) of material from which the envelopes (2) are made.

19. The line according to claim 18, wherein the means for slowing down the filter bags (1) comprise at least one pair of bilateral spring pins (9) transversal to the wings of the folded V-shaped strip (3), said spring pins (9) opposing each other and have, interposed between them, the continuous strip (3) of material from which the envelopes (2) are made.

20. The line according to claim 19, wherein the spring pins (9) have at one end respective free turning disc-shaped members (11) tangent to each other and having, interposed between them, the continuous strip (3) of material from which the envelopes (2) are made.

21. The line according to claim 14, comprising, upstream of the first working section (23), squeezing means (16) designed to redistribute the infusion product inside the filter bag (1), moving at least a part of the infusion product away from the bottom (15) of the filter bag (1), in such a way as to gradually reduce the thickness of the filter bag (1).

22. The line according to claim 21, wherein the squeezing means comprise a plurality of roller pairs (16) positioned one after the other on each side of the strip (3) of material from which the envelopes (2) are made; the spacing between the rollers (16) of each pair gradually decreasing from one pair of rollers (16) to the next in the feed direction (17) of the continuous strip (3) of material from which the envelopes (2) are made.

23. The line according to claim 22, wherein the rollers (16) have a rigid structure.

24. The line according to claim 14, comprising synchronizing means (19, 20) for synchronizing the feed speed of the filter bags (1) with cartoning means (18), in such a way as to maintain a continuous flow of filter bags (1) fed to the cartoning means (18).

25. The line according to claim 24, wherein the speed synchronizing means comprise two continuous conveyor belts (19, 20) having conveyor sections (21, 22) placed face to face and in contact with each other, the filter bags (1) passing between the conveyor sections (21, 22) being accelerated or decelerated according to their instantaneous speed and relative to the instantaneous position of the cartoning means (18) of a third section (25) located further on in the feed direction (17) of the strip (3) of material from which the envelopes (2) are made.

* * * * *